US011749897B2

(12) United States Patent
Wunsch et al.

(10) Patent No.: US 11,749,897 B2
(45) Date of Patent: Sep. 5, 2023

(54) SLOT ANTENNA ASSEMBLY WITH TAPERED FEEDLINES AND SHAPED APERTURE

(71) Applicant: BAE Systems Information and Electronic Systems Integration Inc., Nashua, NH (US)

(72) Inventors: Gregory J. Wunsch, Milford, NH (US); Christopher K. Cheung, Newton, MA (US); Christopher R. Stroili, Nashua, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 78 days.

(21) Appl. No.: 17/091,679

(22) Filed: Nov. 6, 2020

(65) Prior Publication Data

US 2022/0149529 A1 May 12, 2022

(51) Int. Cl.

| | |
|---|---|
| ***H01Q 1/38*** | (2006.01) |
| ***H01Q 13/10*** | (2006.01) |
| ***H01Q 13/02*** | (2006.01) |
| ***H01P 3/00*** | (2006.01) |
| ***H01Q 13/18*** | (2006.01) |
| ***H01Q 1/42*** | (2006.01) |

(52) U.S. Cl.

CPC ..... *H01Q 13/0233* (2013.01); *H01P 3/003* (2013.01); *H01Q 1/42* (2013.01); *H01Q 13/18* (2013.01)

(58) Field of Classification Search

CPC .... H01Q 13/02; H01Q 13/0233; H01Q 13/18; H01Q 1/38; H01Q 1/42; H01Q 13/10; H01P 3/00; H01P 3/003

See application file for complete search history.

(56) References Cited

U.S. PATENT DOCUMENTS

| | | | | |
|---|---|---|---|---|
| 4,929,959 | A * | 5/1990 | Sorbello | H01Q 21/061 343/700 MS |
| 5,061,943 | A * | 10/1991 | Rammos | H01Q 1/38 343/789 |
| 5,748,153 | A * | 5/1998 | McKinzie, III | H01Q 13/085 343/770 |
| 7,646,341 | B1 * | 1/2010 | Lin | H01Q 9/40 343/700 MS |
| 10,186,768 | B2 | 1/2019 | Lewis | |
| 2020/0313288 | A1 * | 10/2020 | Kona | H01Q 1/48 |

* cited by examiner

*Primary Examiner* — Tho G Phan

(74) *Attorney, Agent, or Firm* — Finch & Maloney PLLC; Gary McFaline

(57) ABSTRACT

A slot antenna includes a substrate having a first side and a second side, a first conductive layer on the first side of the substrate, and a second conductive layer on the second side of the substrate. A first aperture is in the first conductive layer, a second aperture is in the first conductive layer, a first slotline is in the first conductive layer and in communication with the first aperture, and a second slotline is in the first conductive layer and in communication with the second aperture. A third aperture can be in the second conductive layer. A plurality of vias can be in the substrate and surrounding at least a portion of a region including the first aperture, the second aperture, the first slotline, and the second slotline, each of the vias extending through the substrate from the first conductive layer to the second conductive layer.

20 Claims, 14 Drawing Sheets

SLOT ANTENNA ASSEMBLY WITH TAPERED FEEDLINES AND SHAPED APERTURE

BACKGROUND

An ideal radio frequency (RF) antenna will radiate 100% of power available from a transmission line connected to an RF source, in the case of a transmitting antenna. Alternatively, in the case of reception, an ideal antenna will send 100% of the power captured by the antenna down a transmission line toward the receiver. To attain the 100% value there must be an exact impedance match between the transmission line impedance, and the antenna impedance. For example, an antenna transmitting RF power must have an impedance of exactly 50 ohms (Ω) as a necessary condition to attain 100% efficiency when connected to a 50Ω transmission line. However, there are other sources of inefficiency, so attaining a perfect impedance match does not guarantee maximum radiated power. When the impedance between transmission line and antenna are mismatched, a reflection occurs, and a reflected wave sends power back toward the RF source, setting up a standing wave in the transmission line. One common measurement of the magnitude of the reflection is known as Voltage Standing Wave Ratio (VSWR). VSWR is the ratio of the maximum (time averaged) voltage existing in the transmission line to the minimum voltage (the maximums located a physical distance of a quarter wavelength from the minimums within the transmission line). An ideal antenna will be perfectly matched, hence no reflected wave, and consequently no standing wave, so for a perfect match, VSWR reaches its lowest possible value, which is unity, or expressed as a ratio, 1:1. Mismatches raise the value of VSWR, so designing an antenna with a minimum value of VSWR maximizes the power that can be radiated, provided other losses are also controlled. The reciprocal case, an antenna receiving, acts in an analogous manner. In this case, a portion of the captured incident RF power is reflected back into the atmosphere when the impedance is mismatched. Impedance mismatches can be mitigated by adding impedance matching components, such as resistors and capacitors. However, these components are bulky and difficult to implement in small scale applications. Therefore, non-trivial impedance mismatching issues remain.

DETAILED DESCRIPTION

Figure 1A:
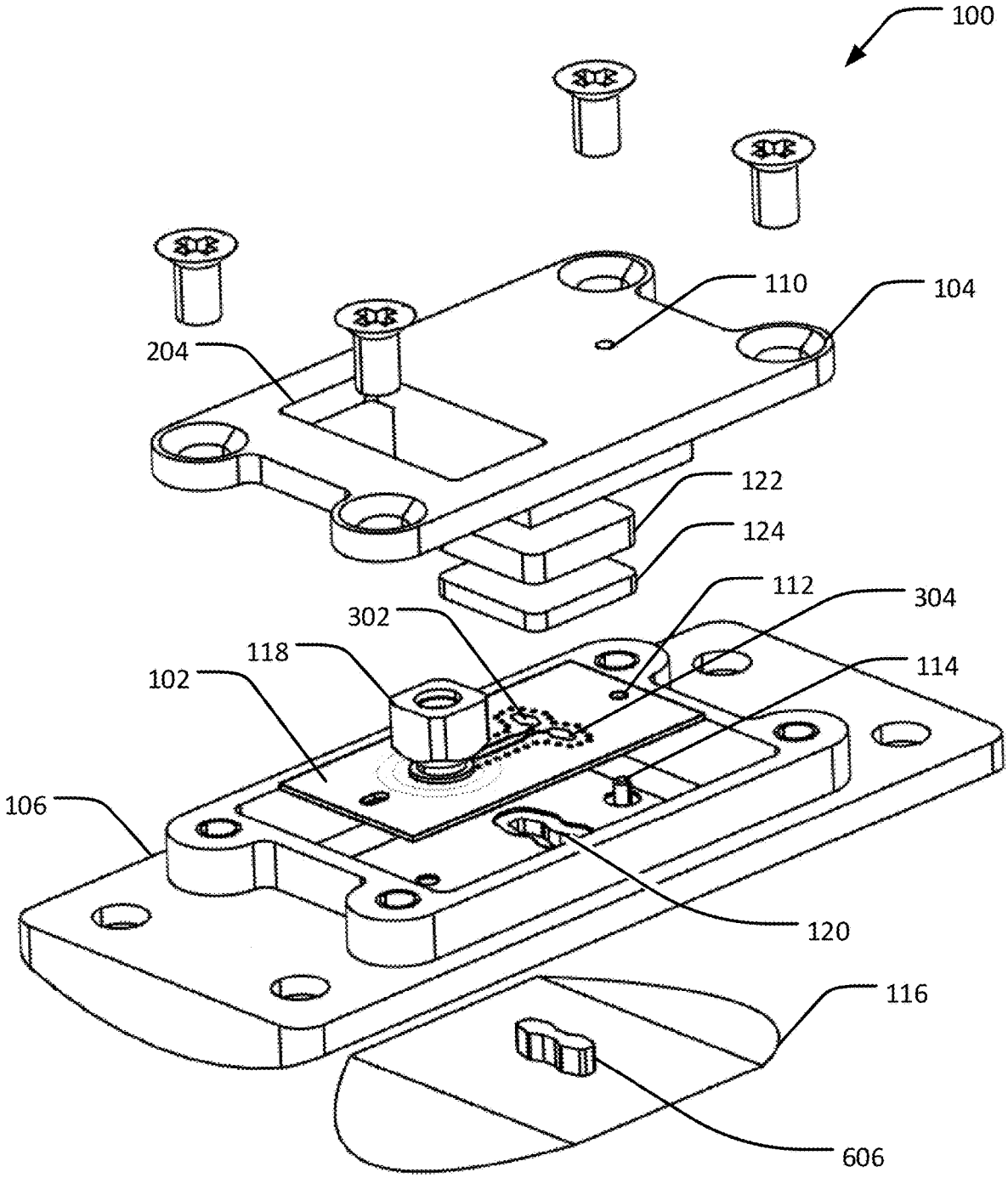
FIG. 1A is an exploded view of an example slot antenna assembly, in accordance with an embodiment of the present disclosure.

Slot antenna assemblies are disclosed. The assemblies are well-suited for compact high band conformal receive antenna applications, such as in applications where the assembly must fit into a relatively tight space of a given platform. However, it will be appreciated that the disclosed designs may benefit other RF applications as well. Example applications for the slot antenna assembly include communications equipment for vehicles (e.g., land, air, and/or sea, whether manned or unmanned), smart munitions, and stationary applications (e.g., ground stations). According to an embodiment, a slot antenna assembly includes a cavity-backed PCB assembly with an integrated radome. The PCB assembly includes conductive (metal) layers applied to a substrate. The conductive layers have apertures and coplanar waveguide transmission lines that are tapered to improve impedance matching without using additional components, such as resistors and capacitors. In some such embodiments, the antenna radome can be cast in place to the aperture plate using a mold, which reduces complexity, parts count, and the need for expensive machining operations. Numerous embodiments and variations will be appreciated in light of this disclosure.

General Overview

As noted above, impedance mismatches in an antenna can cause undesirable voltage and current reflections, which distort the signal and affects the performance of a given communications system. According to the theory of electromagnetic radiation, a perfect impedance match between an antenna and a transmission line can only be achieved at a discrete set of frequency points, and not through a band (continuum) of frequencies, at least if the antenna radiates RF power. One of the main goals of most antenna design is to minimize this mismatch through a specified band of frequencies. Impedance matching techniques incorporating devices such as resistors, capacitors, transformers, and other components are used in some designs to achieve better performance over significant bandwidths. However, the use of such discrete devices has the drawback of adding a certain amount of loss to the antenna, resulting in portions of the available power converted to heat, rather than radiating into the atmosphere, thereby reducing the radiation efficiency. Resistors are particularly noted for causing such losses. Additionally, at higher frequencies, resistors, capacitors and other impedance matching components start showing significant parasitic effects. For instance, at lower frequencies a capacitor will act substantially as an ideal capacitor from circuit theory. But at higher frequencies (when the size of the component is a substantial fraction of a wavelength), the leads of the capacitor act as inductors, the case and dielectric material act as resistors. These parasitic effects can be unpredictable, differing from individual capacitor to capacitor due to tiny manufacturing differences. Thus, parasitic effects can lead to difficult design problems and potential manufacturing yield problems. Furthermore, the use of these discrete devices add cost to manufacturing process and also add bulkiness to the antenna assembly, causing size problems if the antenna is intended to have a small form factor. For antennas with very low VSWR requirements, and large frequency bandwidths, the use of these devices might be necessary, but in light of this, it is advantageous to avoid these devices if possible.

To this end, and in accordance with various embodiments of the present disclosure, a slot antenna assembly includes, in conductive layers on a substrate, shaped apertures and tapered feedlines to reduce or eliminate the need for impedance matching components, such as resistors and capacitors. As discussed in further detail below, various aperture shapes and feedline transitions to the aperture can potentially benefit VSWR frequency characteristics and gain patterns.

Example Antenna Assembly

FIG. 1A shows an example slot antenna assembly 100, in accordance with an embodiment of the present disclosure. The slot antenna assembly includes a PCB assembly 102, which is positioned between a cover 104 and an aperture plate 106. The cover 104 provides access to a radio frequency (RF) connector 118 of the PCB assembly 102, while also protecting the PCB assembly 102 from RF interference and physical debris. The PCB assembly 102 has one or more apertures 302 and 304, such described in further detail with respect to FIGS. 3A and 3B. The aperture plate 106 has an antenna aperture 120 shaped to match the apertures 302 and 304 in the PCB assembly 102. The antenna aperture 120 is covered by a radome 116. The radome 116 can be made from a dielectric material.

In some examples, the PCB assembly 102 is adhered to the aperture plate 106 with a bonding adhesive 108 so that the apertures 302 and 304 align with the antenna aperture 120 of the aperture plate. Many bonding adhesives 108 can be used to adhere the PCB assembly 102 to the aperture plate 106. In some cases, the adhesive 108 is electrically and/or thermally conductive, flexible, and/or removable. In some embodiments, an epoxy film or an adhesive film that is designed for bonding materials with mismatched coefficients of thermal expansion, such as LOCTITE® ABLESTIK ECF561, can be used, but it will be understood that other conductive adhesive materials can be used. Other methods of attachment can also be used such as double-sided tape, snap locks, screws, lock teardrops, snap rivets, and edge holders. In some embodiments, the PCB assembly 102, cover 104, and aperture plate 106 are aligned or otherwise located with respect to each other using a pin and hole alignment system. For example, the aperture plate 106 can include a pin 114 that aligns with a hole 110 or recess in the cover 104 and a hole 112 through the PCB assembly 102.

Some embodiments include a carbon-based, antireflection (ARC) absorber 122 and a spacer 124 positioned between the cover 104 and the shaped apertures 302 and 304 of the PCB assembly 102. The absorber 122 can include a high loss dielectric or similar material, which eliminates or reduces reflection of received RF signals, after passing through the apertures 302 and 304, on the transmission signal, causing destructive interference. The spacer 124 keeps the absorber 122 from loosening during the vibrations of operation, mechanical shock, or other interfering forces. The spacer 124 can be made from any low loss dielectric material, such as a material that simulates the properties of air by having a relative dielectric constant approaching 1.0. In some embodiments, the spacer 124 can be a closed-cell rigid, plastic based foam such as ROHACELL®. The thicknesses of the absorber 122 and the spacer 124 can vary based on the design of the slot antenna assembly 100. In some embodiments, such as depicted in FIGS. 1A-B, the combined thickness of the absorber 122 and the spacer 124 is approximately ⅛ to ⅜ of a wavelength of the transmitted and/or received RF signals.

The antenna 100 uses the RF connector 118 to communicate the signal that is sent or received by the PCB assembly 102. The RF connector 118 can include, for example, a sub-miniature push-on (SMP) connector, although it will be understood that other suitable connectors can be used. The type of connector 118 used can depend on the application of the slot antenna assembly 100 and the cavity space available.

Figure 1B:
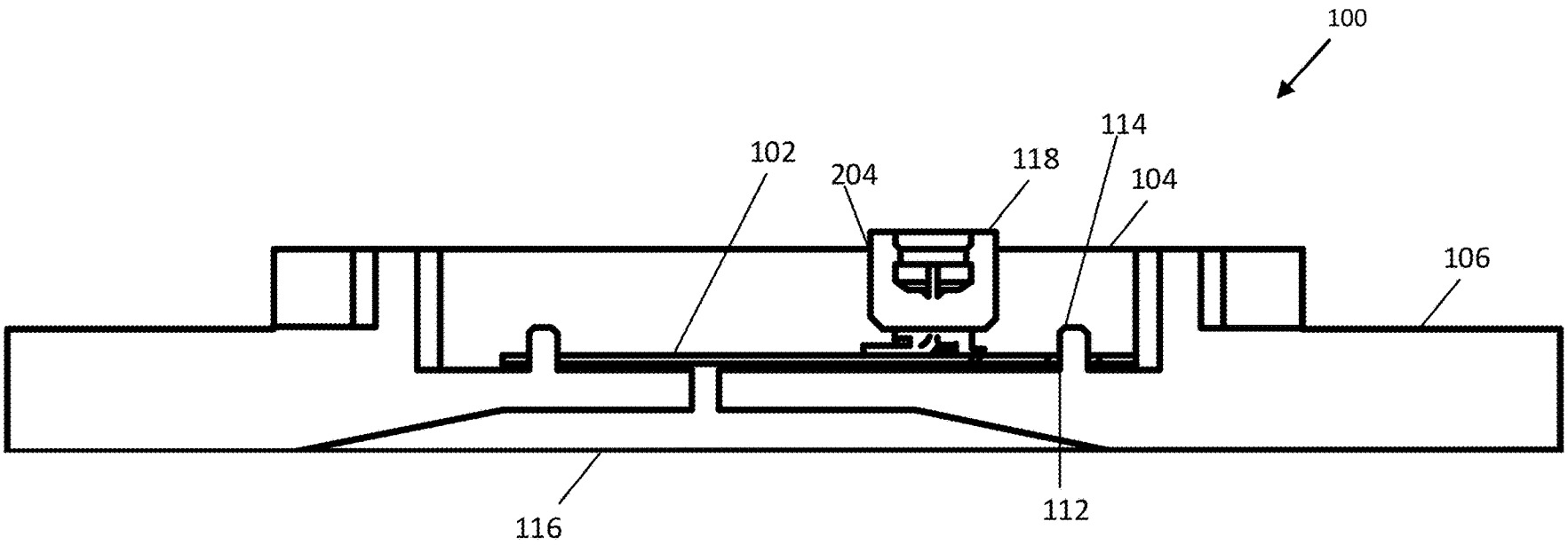
FIG. 1B is a cross section of a side view of an example assembled slot antenna assembly, in accordance with an embodiment of the present disclosure.

FIG. 1B is a cross-sectional side view of an assembled slot antenna assembly 100. As previously described, the PCB assembly 102, is positioned between the cover 104, and the aperture plate 106. The slot antenna 102 is located so that the connector 118 is aligned with and protrudes from the RF connector port 204 located in the cover 104. The example PCB assembly 102 is further located by the hole 112 of the PCB assembly 102 which aligns with the pin 114 of the aperture plate 106.

Figure 2B:
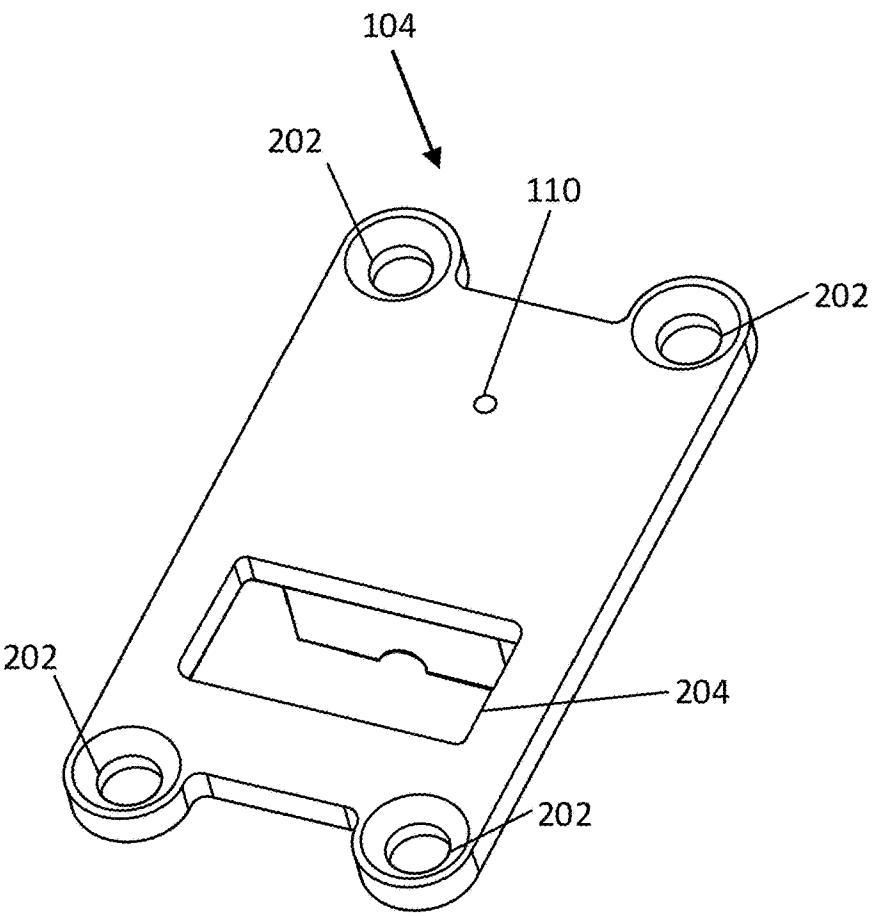
FIGS. 2A and 2B are isometric views of a first side and a second side, respectively, of an example cover of a slot antenna assembly, in accordance with an embodiment of the present disclosure.
Figure 2A:
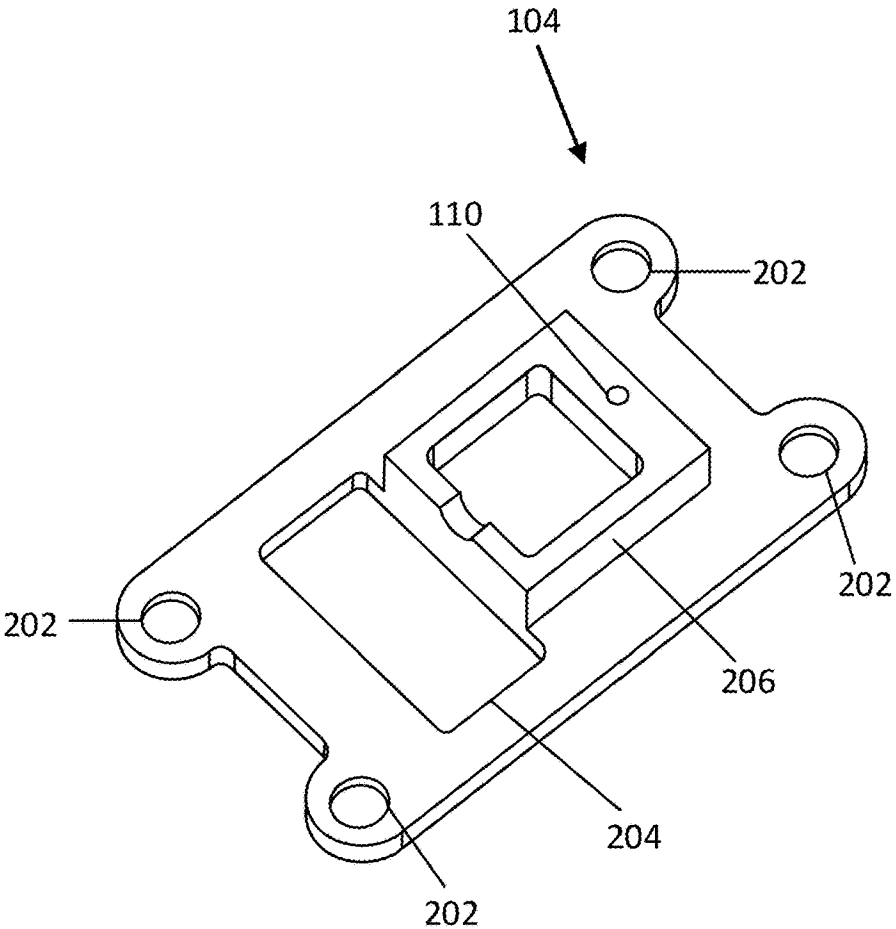

FIGS. 2A and 2B show two sides of the cover 104. The cover 104 protects the PCB assembly 102 from debris and damage. In this example, four screw holes 202 are provided for attaching the cover 104 to the aperture plate 106 with screws or other types of fasteners. The cover 104 includes an RF connector port 204, which provides access to the RF connector 118 of the PCB assembly 102.

FIG. 2A shows the side of the cover 104 that is oriented towards the PCB assembly 102, with respect to slot antenna assembly 100. The raised cavity 206 provides space for the spacer 124 and absorber 122 of the slot antenna assembly 100 while seated inside the cavity 206. In some embodiments, the hole 110 aligns with the pin 114 when cover 104 is attached to the aperture plate 106. The cover 104 can be constructed out of rigid, electrically conductive materials such as aluminum, aluminum alloy, nickel iron alloy, stainless steel, steel, zinc, zinc alloy, graphite, and carbon fiber reinforced polymers, or of non-electrically conductive materials plated with an electrically conductive material.

Figure 3A:
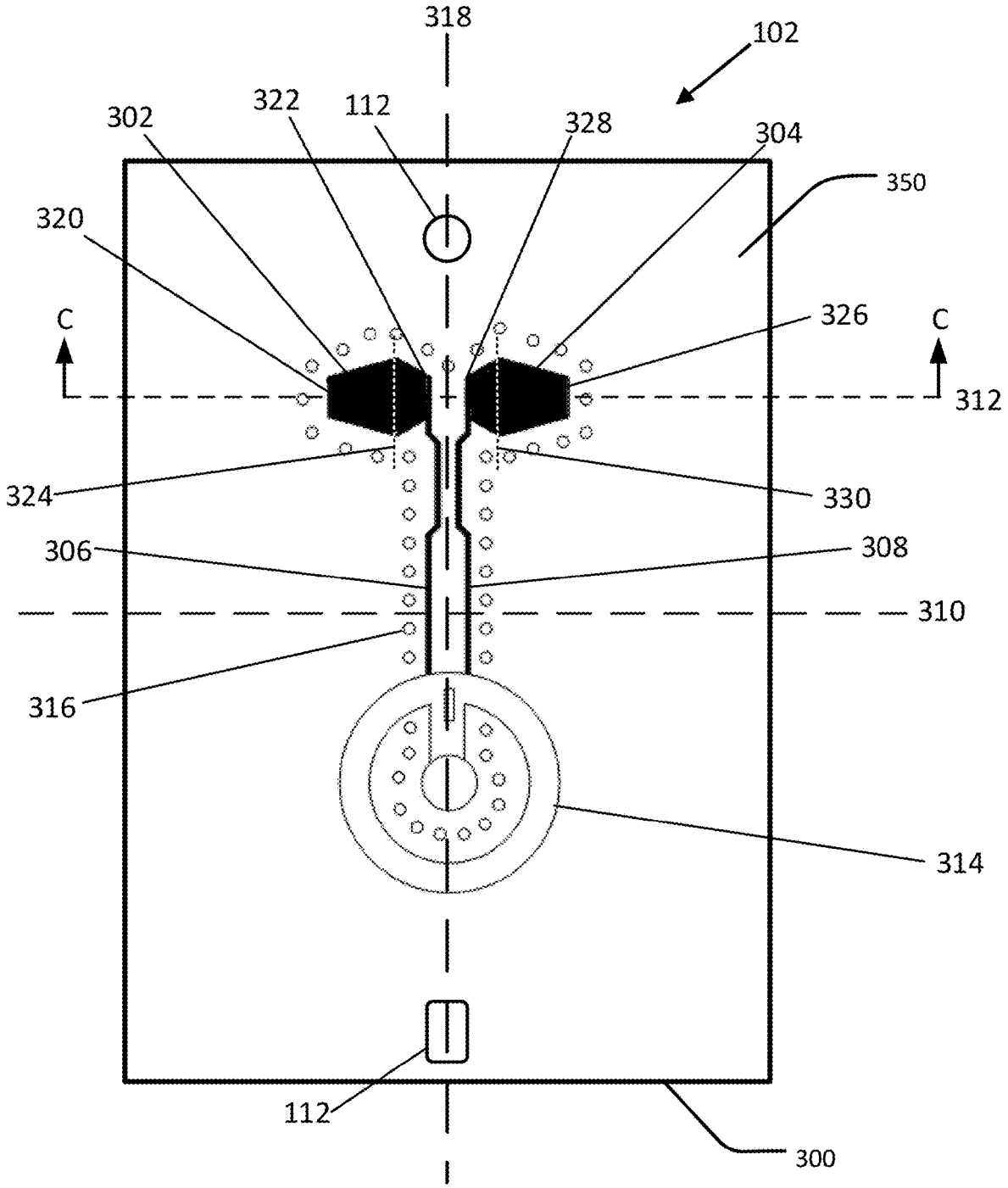
FIG. 3A is a plan view of a first side of an example printed circuit board (PCB) of a slot antenna assembly, in accordance with an embodiment of the present disclosure.

FIGS. 3A-D show portions of the PCB assembly 102. FIG. 3A is a plan view of a first side 350 of a PCB 300. The first side 350 of the PCB 300 includes two apertures 302 and 304, two slotlines 306 and 308, an RF connector 314, and a series of vias 316 at least partially surrounding a region including the apertures 302, 304, 334 (see FIGS. 3B-C), the slotlines 306, 308, and the RF connector 314. The slotline pair 306, 308 form what is known as a coplanar waveguide, which excites the apertures 302 and 304 simultaneously. In some embodiments, the two slotlines 306, 308 are mirror images of each other about a centerline. The vias 316 are openings extending through the PCB 300 that provide a Faraday cage around the apertures 302, 304, 334, the slotlines 306, 308, and the RF connector 314. In some examples, the vias 316 are approximately 1/10 of a wavelength (as transmitted or received by the antenna) apart from each other. As previously explained, the PCB assembly 102 also includes two holes 112 to align or locate the aperture plate 106, PCB assembly 102, and cover 104.

Figure 3B:
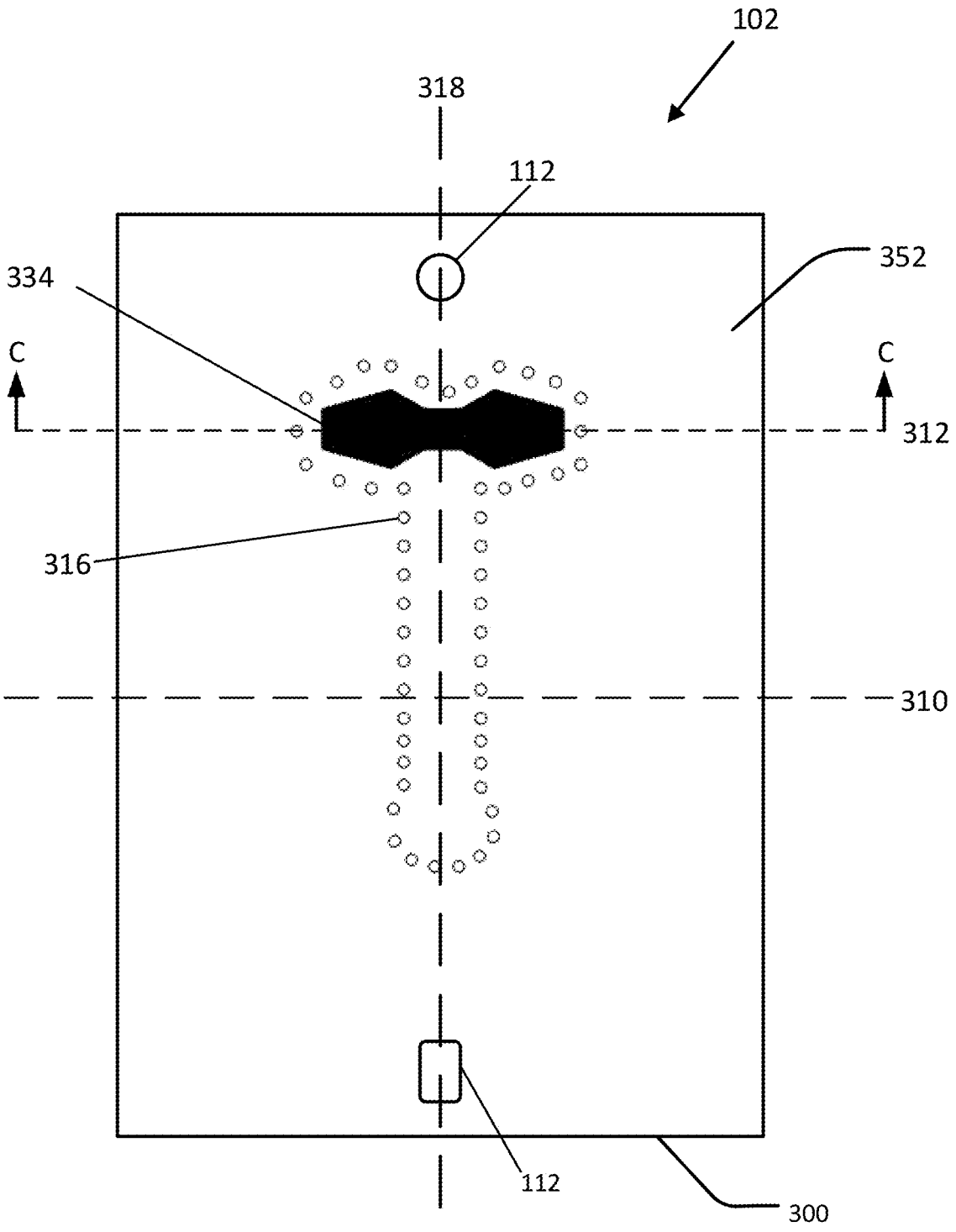
FIG. 3B is a plan view of a second side of the example PCB of FIG. 3A, in accordance with an embodiment of the present disclosure.
Figure 4A:
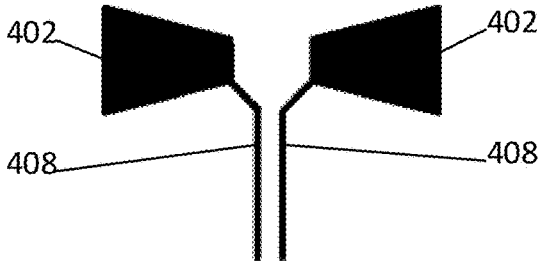
FIGS. 4A, 4B, and 4C are example aperture and slotline designs, in accordance with embodiments of the present disclosure.
Figure 4B:
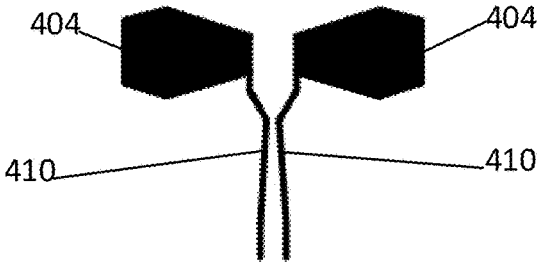
Figure 4C:
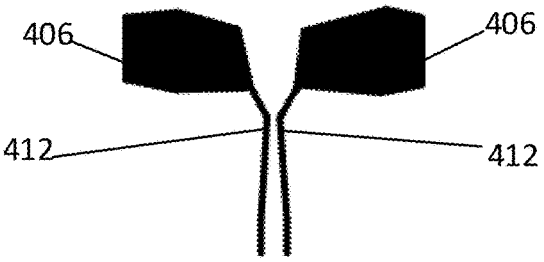

Each aperture 302 and 304 has two ends 320/326 and 322/328, and a width 324/330 that are orthogonally oriented about a lateral axis 310 of the substrate 332 and parallel to a longitudinal axis 318 of the substrate 332. The ends 320/326 and 322/328 as well as the width 324/330 are aligned with one another about a second lateral axis 312 that is parallel to the lateral axis 310 of the substrate 332. Note, orthogonal, as used here, does not require precise ninety-degree angles, and parallel, as applied here, does not require infinite expansion without intersection. In some examples, the width 324/330 of the apertures 302 and 304 is larger than each of the two ends 320/326 and 322/328 and positioned closer to the end 322/328, which is located closer to the tapered feedlines 306 and 308. The feedlines 306 and 308 are tapered along a length of the longitudinal axis 318. While FIGS. 3A and 3B show one tapered aperture shape, other tapered aperture shapes are also possible, such as the example apertures shown in FIGS. 4A-C at 402, 404, and 406.

The apertures 302, 304, 402, 404, and 406 optimize the VSWR ratio of the antenna 102 and thus reduce or eliminate the need for additional impedance matching elements. The angular shapes of the apertures 302, 304, 402, 404, 406 generate two regions of electric field on the substrate 332 that oscillate in phase with each other. The described regions are those on the substrate 332, when receiving or sending a RF signal, where the transmission lines diverge to a nearly orthogonal angle from their original parallel state, allowing the electric fields to oscillate in phase, rather than out of phase (as in the transmission lines), thus creating the source for the radiated RF energy. In some embodiments, these isolated regions are identified through electromagnetic simulations and optimization techniques.

In some examples, the apertures 302, 304, 402, 404, 406 are mirror images of one another about a longitudinal axis 318. For example, the shape of the aperture 302 is substantially the same as a shape of the aperture 304 mirrored across the longitudinal axis 318. In some examples, the first aperture 302 and second aperture 304 are not mirror images of one another. For example, the aperture 302 can be larger than 304. The width 324 can be larger than the width 330. The end 328 can be closer to the longitudinal axis 318 than 322. The two apertures 302 and 304 can be different shapes from one another.

An example PCB 300 of this type, with apertures like those described, is capable of operating within the Ka microwave band. With operation at a lower frequency of approximately 26 GHz and an upper frequency of approximately 40 GHz.

Referring again to FIG. 3A, the PCB 300 includes at least two slotlines 306 and 308 on the first side 350. Each slotline, 306 and 308, begins at one of the two apertures 302 and 304 and terminates at the RF connection point 314, which connects to the RF connector 118 discussed in reference to FIG. 1. In some examples, the PCB 300 includes a plurality of circular vias 316, patterned around the slotlines 306 and 308 and apertures 302 and 304.

The angle at which the slotlines 306 and 308 approach and connect to the apertures 302 and 304 affect the slot antenna's VSWR. FIG. 3A and FIGS. 4A-C show some alternative angles of the slotline 306 and 308 connections to the apertures 302, 304, 402, 404, 406. To improve the VSWR, each feedline 306 and 308 is tapered or angled along the length towards the longitudinal axis 318 of the PCB 300. The apertures 302, 304 and slotlines 306, 308 are shown as substantially polygonal. However, these shapes can, for example, be curved or radiused at the corners.

In some embodiments, the width 324 of the aperture 302 along the second lateral axis 312 varies as a function of a distance from the first slotline 306, and the width 330 of the second aperture 304 along the second lateral axis 312 varies as a function of a distance from the second slotline 308. For example, as shown in FIGS. 3A, 4A, 4B, and 4C, the width of the apertures 302, 304, 402, 404, 406 varies, such that each of the apertures has a particular shape. The shape of the apertures 302, 304, 402, 404, 406 helps to mitigate impedance mismatches of the antenna assembly.

Figure 3C:
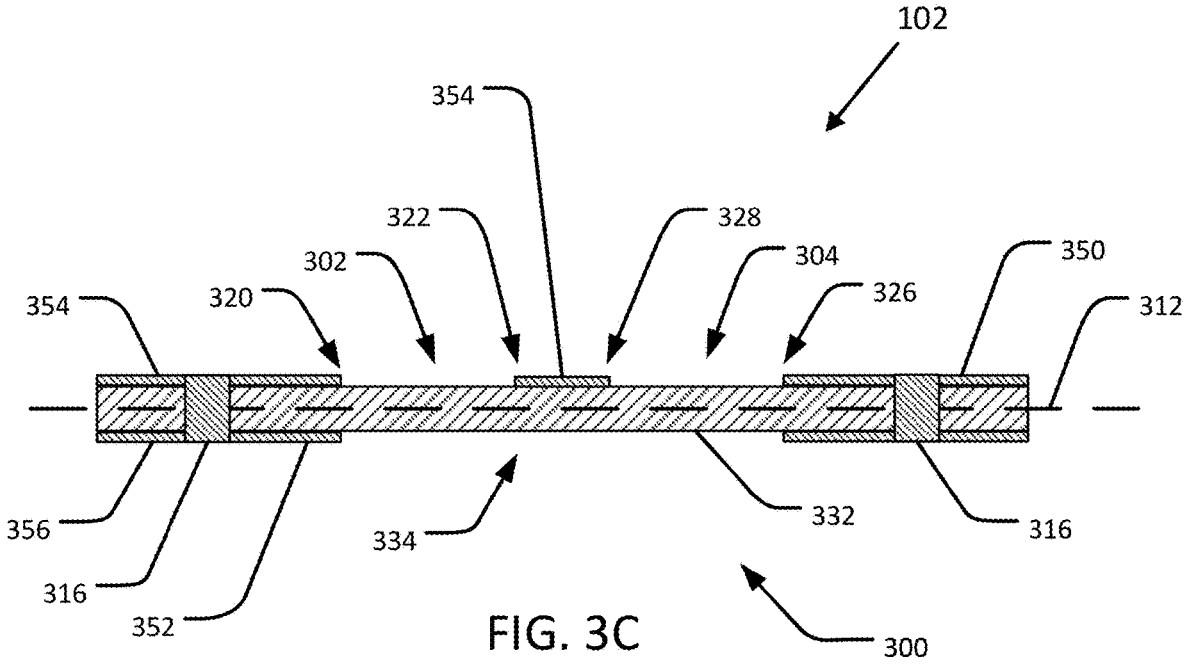
FIG. 3C is a cross sectional view of the example PCB of FIG. 3A, in accordance with an embodiment of the present disclosure.

FIG. 3B shows a second side 352 of the PCB 300. The second side 352 of the PCB 300 includes an aperture 334 that is opposite from, and thus generally aligned with, the apertures 302 and 304. The aperture 334 has a shape that is similar to the shapes of the apertures 302 and 304 on the first side of the PCB 300, such as described above. Additionally, the aperture 334 extends between the two portions having the same shapes as the apertures 302 and 304 to create one contiguous aperture on the second side 352 of the PCB 300, such as shown in FIGS. 3B-C. In some examples, the second side 352 of the PCB 300 is adhered to the aperture plate 106. In some examples, the aperture plate pin 110 is aligned with the PCB 300 using the pin holes 112.

The PCB 300 can be manufactured, for example, using an etching process or a metallization process. FIG. 3C shows a cross section along cut line C-C, which is along the longitudinal axis 312 depicted in FIGS. 3A-B. The PCB 300 begins as a substrate 332. The substrate 332 can be any dielectric material, such as duroid, ceramic PFTE, silicon or other compound III-V or II-VI materials.

If a metallization process is used, the substrate 332 has first and second conductive layers 354 and 356 deposited on the first side 350 and the second side 352 of the substrate 332, respectively. If an etching process is used, the substrate 332 is purchased with complete sheets of metal on each side, and metal is etched away where it is not wanted, to form an equivalent structure. The conductive layers are typically copper, but in some embodiments can include other metals such as aluminum, nickel, gold, silver, titanium, tungsten, platinum, or other materials with comparable electrically conductive properties. Metallization can, for example, involve filament evaporation, electron-beam evaporation, flash evaporation, induction evaporation, and sputtering, or other similar processes. In some embodiments, the vias 316 are filled with the same material as the conductive layers 354, 356.

For the etching option, portions of the conductive layers 354, 356 are etched (chemically or by use of lasers) or completely removed from the pre-metallized substrate 332 to form the apertures 302, 304, and 320, and the feedlines 306 and 308. Thus, the apertures 302, 304, 320 are in the respective conductive layers 354, 356.

Figure 3D:
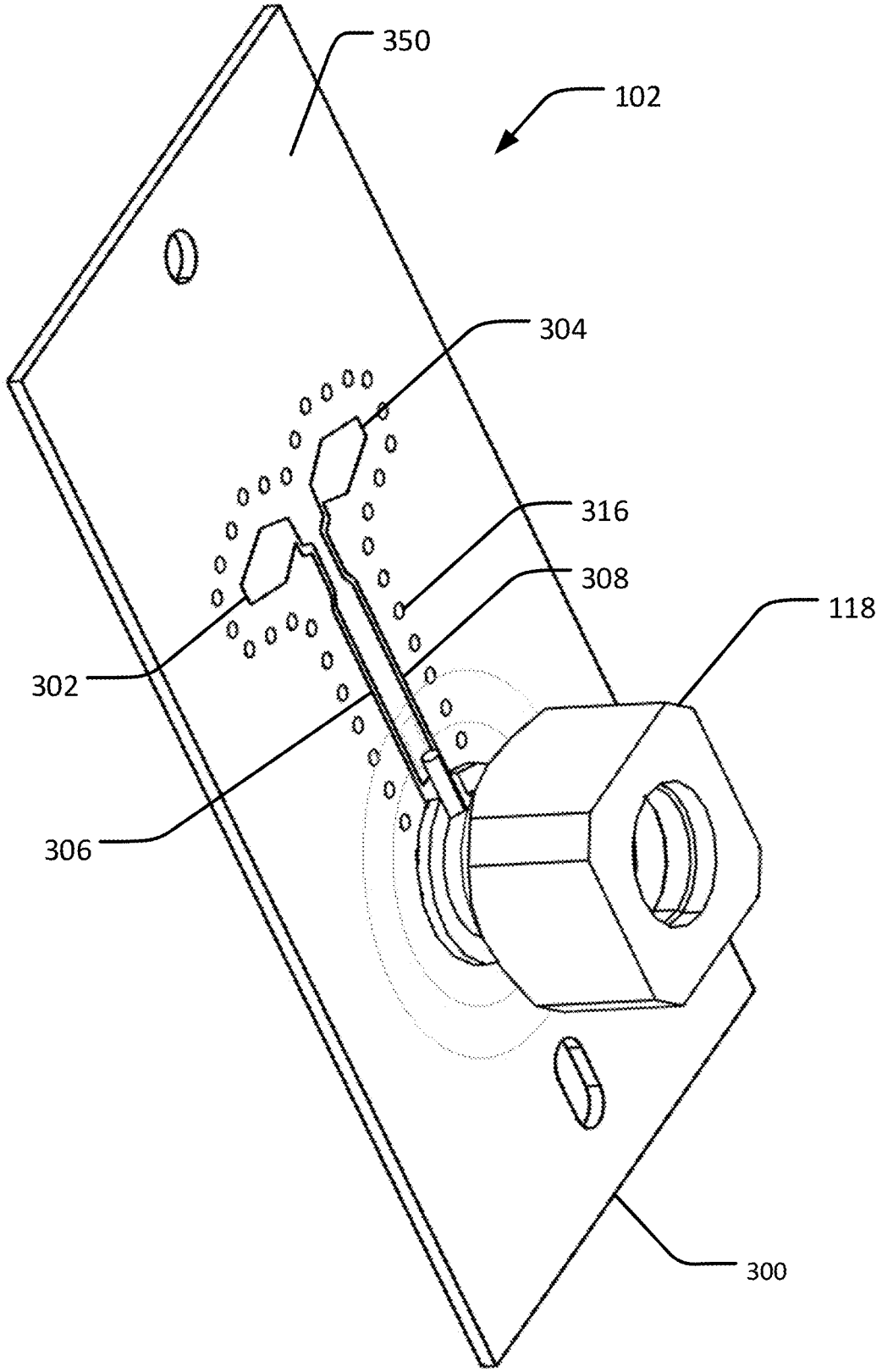
FIG. 3D is a perspective view of an example PCB assembly including the PCB of FIG. 3A, in accordance with an embodiment of the present disclosure.

FIG. 3D is a perspective view of the PCB assembly 102, including the PCB 300 of FIGS. 3A-C and the RF connector 118 attached to the RF connection point 314 of the PCB 300.

Figure 5A:
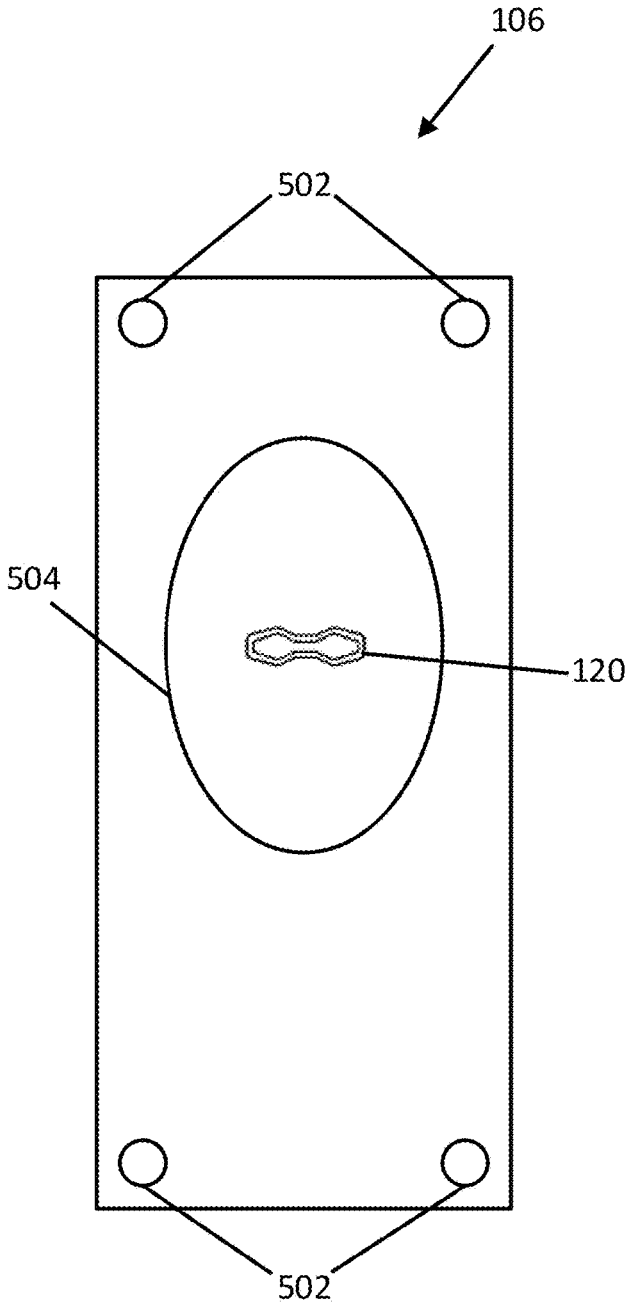
FIGS. 5A and 5B are plan views of a first side and a second side, respectively, of an example aperture plate of a slot antenna assembly, in accordance with an embodiment of the present disclosure.
Figure 5B:
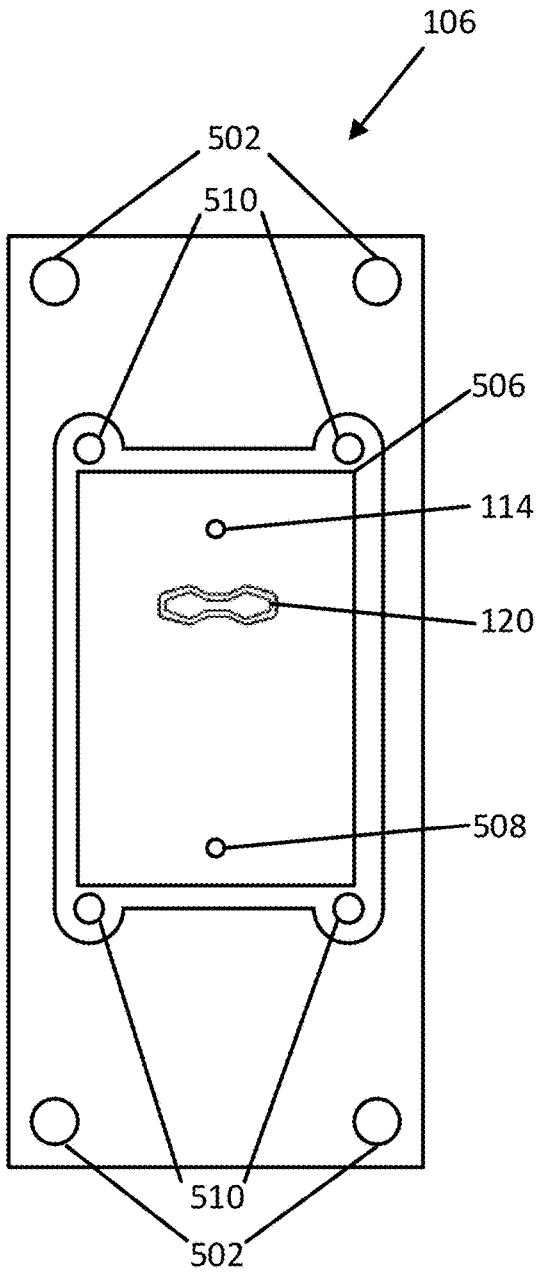

FIGS. 5A-B show an example of the aperture plate 106. The aperture plate 106 can be flat or curved. Both a flat and curved aperture plate 106, in conjunction with the radome, create the fish-eye lens effect, explained previously, which increases the antenna's FOV without having a significant effect on the recognized frequency range or VSWR ratio of the slot antenna assembly 100. In this example, the aperture plate 106 is mounted in place using through holes 502 and corresponding fasteners. The fasteners can, for example, include screws with threaded through holes or any other type of attachment.

FIG. 5A also shows an example of the outermost side of the aperture plate 106. The aperture plate 106 includes a shaped recess 504 around the antenna aperture 120. This shaped recess 504 allows the radome 116 to sit flush with the surface of the aperture plate 106.

FIGS. 5A and 5B also show an example of the antenna aperture 120. The shape of the antenna aperture 120 can match the shape of the apertures 302 and 304 in the PCB assembly 102. By matching the shape of the antenna aperture 120 to the shape of the apertures 302 and 304, impedance mismatching, return loss, and/or VSWR affects are reduced.

FIG. 5B also shows an example of the innermost side of the aperture plate 106, to which the PCB assembly 102 and cover 104 are attached. The innermost side has a recess 506 that aligns the shaped apertures 302 and 304 in the PCB assembly 102 with the antenna aperture 120 in the aperture plate 106. The pins 114 and 508 align with the holes 112 on the PCB assembly 102. As previously described with respect to FIGS. 2A and 2B, the cover 104 attaches to the aperture plate 106 by aligning the four cover through holes 202 with the aperture plate through holes 510 and joining them with a screw or other suitable fastener. In some embodiments the through holes may be threaded. The cover can be attached using alternative fasteners such as a turn key or latch, or the assembly may not include an attachment method and continue to operate as described.

Figure 6A:
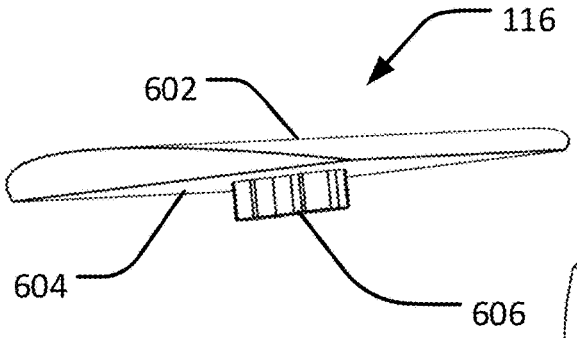
FIGS. 6A and 6B are perspective views of a first side and a second side, respectively, of an example radome of a slot antenna assembly, in accordance with an embodiment of the present disclosure.
Figure 6B:
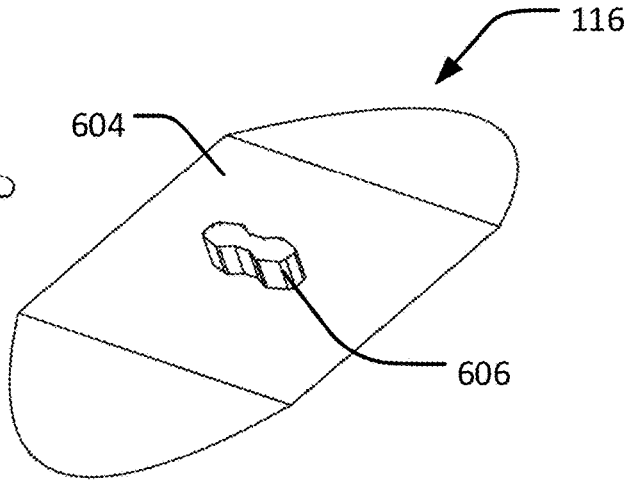

FIGS. 6A and 6B show an example of the radome 116. The radome 116 includes a dielectric material that presents a lower characteristic impedance than air to radio signals and is useful in impedance matching the antenna over the desired frequency band of the incoming (or transmitted) signal. The first side 602 of the example radome 116, which is generally outward facing, has a substantially curved surface, which is intended to conform to the surface of the object in which it is installed (a conformal aperture). For example, the radome 116 creates a "fish-eye lens" effect in transmission and reception, which expands the slot antenna's field of view (FOV). However, it will be understood that the outwardly facing surface of the radome 116 can have any suitable shape, including planar (flat), in some embodiments, and that this shape can focus, or defocus (in the case of a fish-eye lens) the pattern of the antenna to some extent. The second side 604 of the example radome has a surface shape 606 that fits over and within the antenna aperture 120. The radome 116 material is impact-resistant, which helps protect the antenna and its performance from debris, such as sleet, hail, and insects. The radome 116 can be made of a plastic, such as UV grade ABS, Korad capped ABS, thermoplastic polyolefin (TPO), or other suitable materials. In some examples, the radome 116 is cast in place including, for example, thermoformed plastic, injection molded plastic, gas assist, structural foam, custom blow molding, or any other suitable mold in place techniques. The radome is also useful in accomplishing the fish-eye lens affect described previously, due to its lower characteristic impedance to RF signals.

Figure 7:
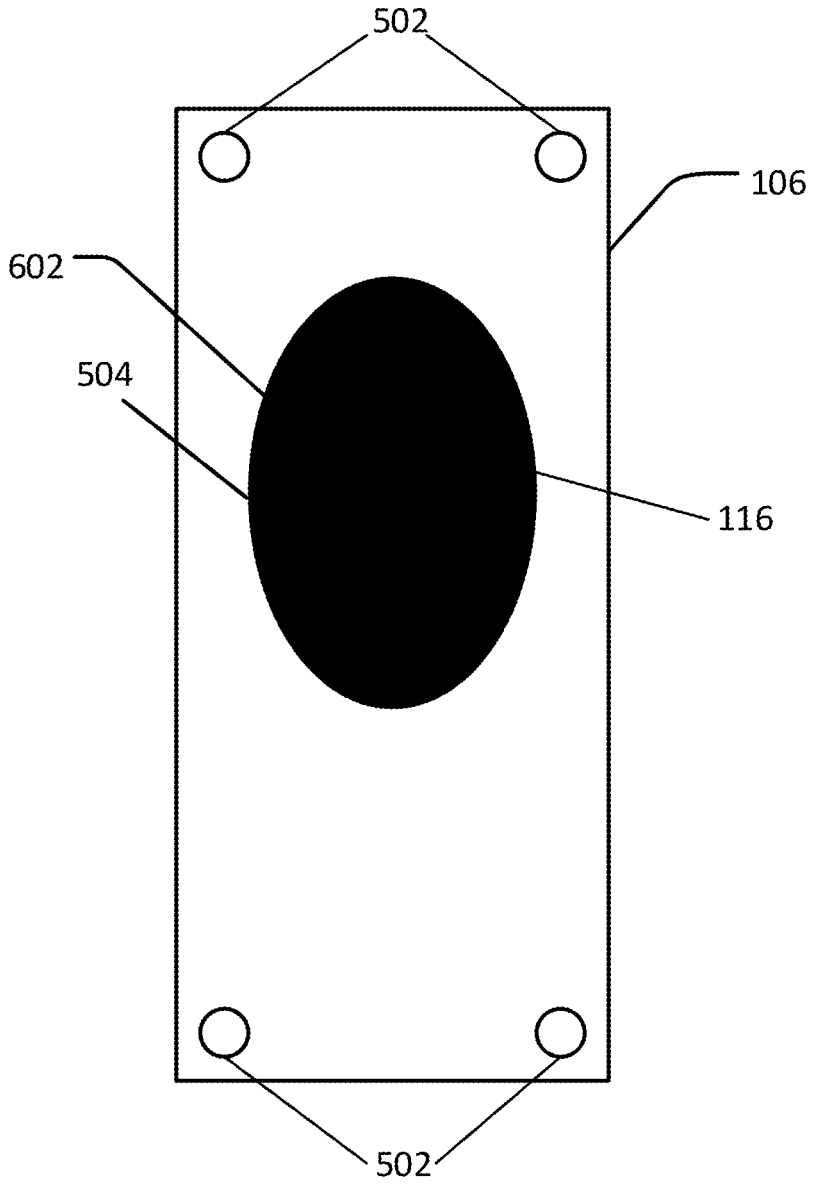
FIG. 7 is a plan view of an example radome, cast in place, on an example aperture plate of a slot antenna assembly, in accordance with an embodiment of the present disclosure.

FIG. 7 shows an example of the aperture plate 106 of FIG. 5A, with the radome 116 of FIGS. 6A and 6B, positioned within the shaped recess 504, the first side 602 of the radome 116 facing outward. FIG. 7 illustrates a cast in place radome 116 but as previously explained other radomes can be used.

Simulated and Measured Results

Figure 8:
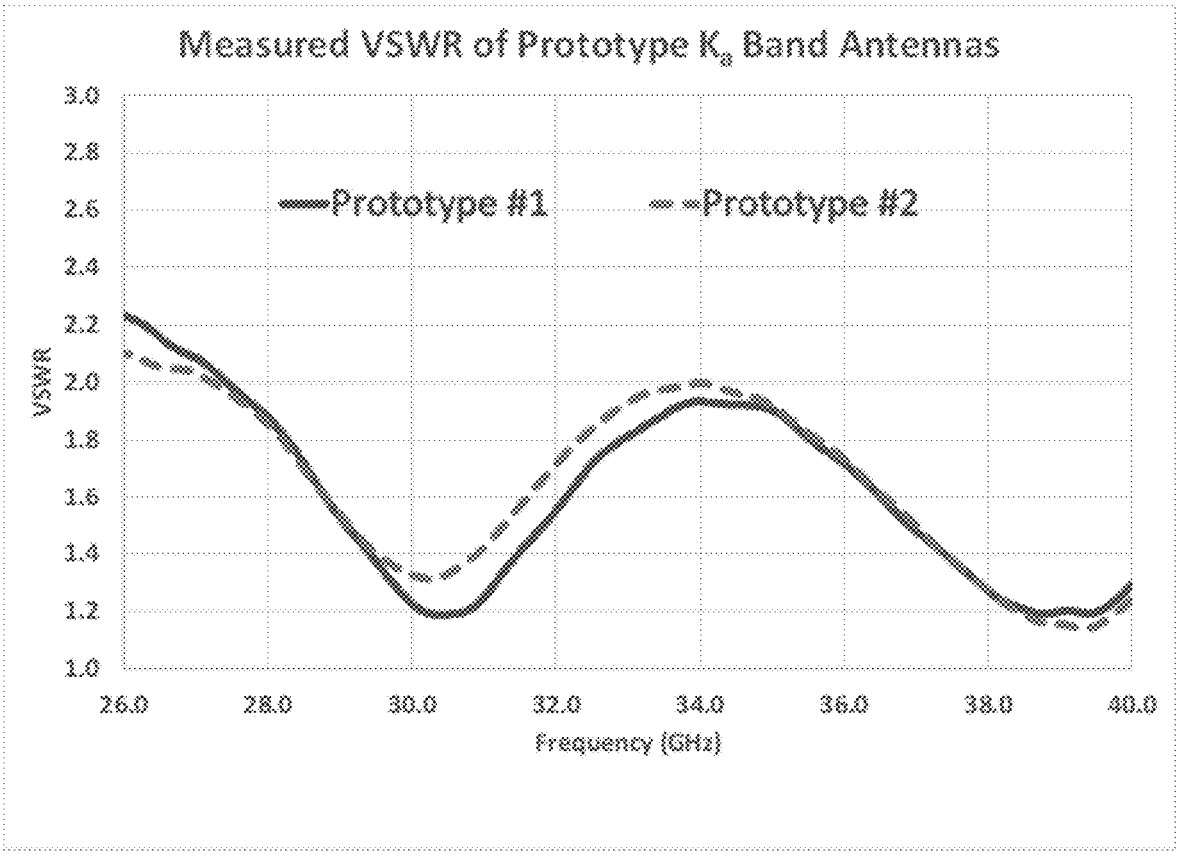
FIG. 8 illustrates measured VSWR for several example slot antenna assemblies that implement the aperture designs illustrated in FIGS. 1A and 3A-B.

FIG. 8 illustrates measured VSWR for two prototype slot antenna assemblies that implement the aperture design illustrated in FIGS. 1A and 3A-B.

Figure 9A:
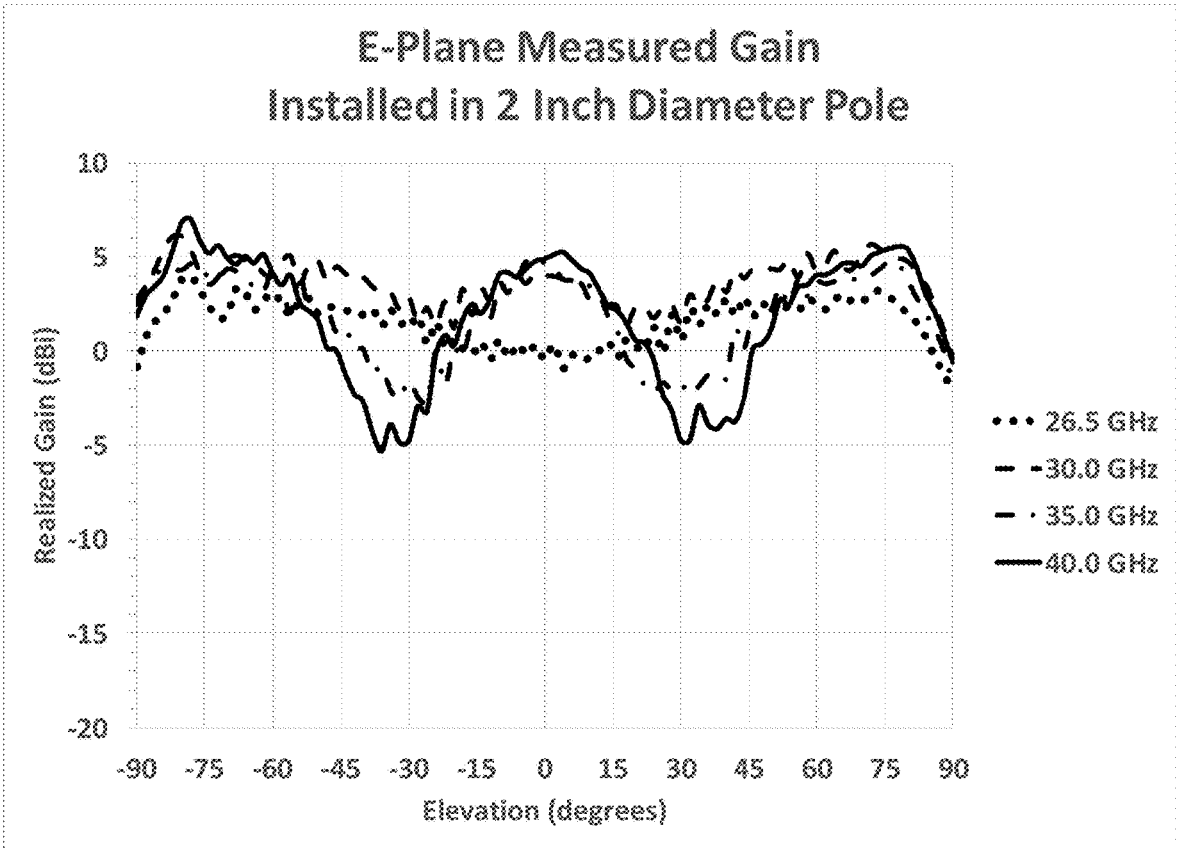
FIG. 9A illustrates measured elevation gain of the example slot antenna assembly depicted in FIGS. 1A, 3A and 3B at different frequencies, when the example antenna is installed in a two-inch diameter pole.
Figure 9B:
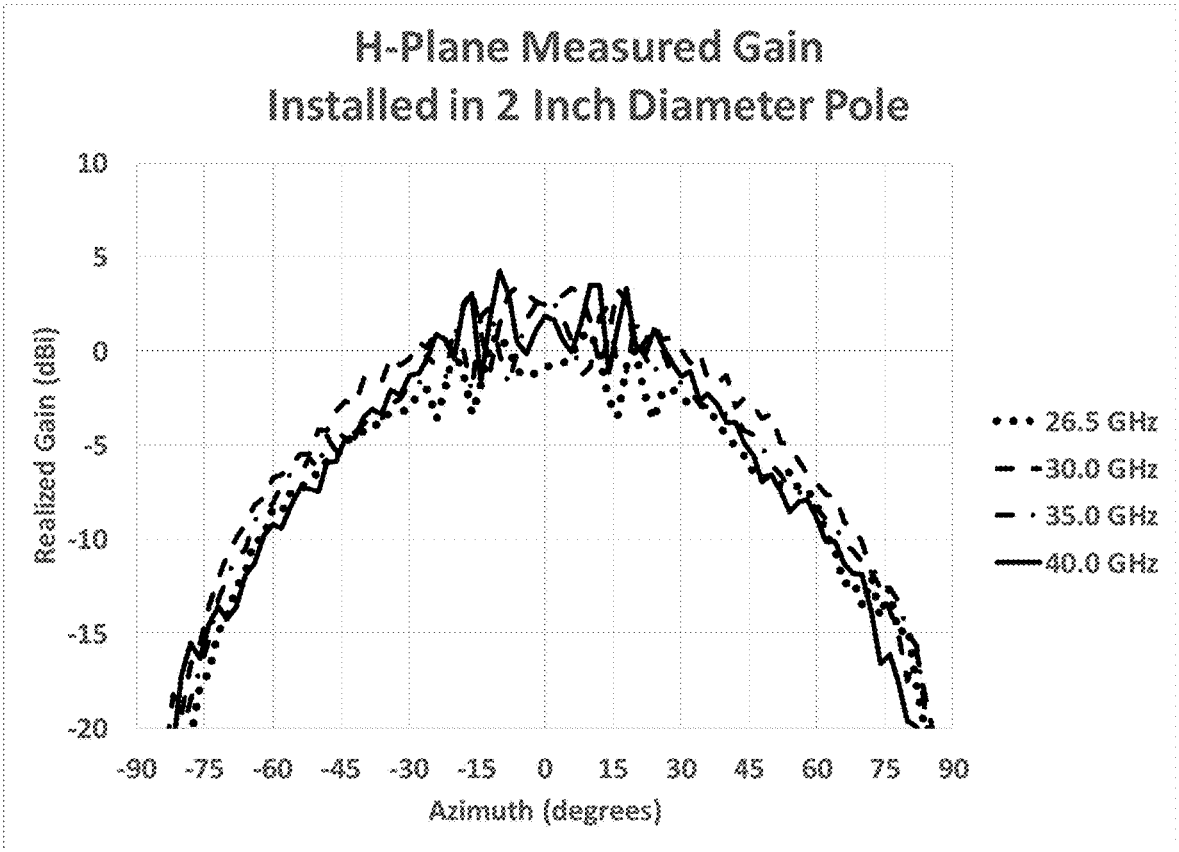
FIG. 9B illustrates measured azimuth gain of the example slot antenna assembly depicted in FIGS. 1A, 3A and 3B at different frequencies, when the example antenna is installed in a two-inch diameter pole.

FIG. 9A illustrates measured elevation gain of the example slot antenna assembly depicted in FIGS. 1A, 3A and 3B at different frequencies, when the example antenna is installed in a two-inch diameter pole. FIG. 9B illustrates measured azimuth gain of the example slot antenna assembly depicted in FIGS. 1A, 3A and 3B at different frequencies, when the example antenna is installed in a two-inch diameter pole.

ADDITIONAL EXAMPLES

Numerous embodiments will be apparent in light of the present disclosure, and features described herein can be combined in any number of configurations.

Example 1 provides a slot antenna including a substrate having a first side and a second side; a first conductive layer on the first side of the substrate; a second conductive layer on the second side of the substrate; a first aperture in the first conductive layer; a second aperture in the first conductive layer; and a coplanar waveguide having a first slotline in the first conductive layer and in communication with the first aperture, and a second slotline in the first conductive layer and in communication with the second aperture, the coplanar waveguide configured to excite the first and second apertures simultaneously.

Example 2 includes the subject matter of Example 1, and further includes a plurality of vias in the substrate and surrounding at least a portion of a region including the first aperture, the second aperture, the first slotline, and the second slotline, each of the vias extending through the substrate from the first conductive layer to the second conductive layer.

Example 3 includes the subject matter of any of Examples 1-2, further including a radio frequency (RF) connector in communication with the first slotline and the second slotline.

Example 4 includes the subject matter of any of Examples 1-3, where a width of the first aperture varies as a function of a distance from the first slotline, and wherein a width of the second aperture varies as a function of a distance from the second slotline.

Example 5 includes the subject matter of any of Examples 1-4, where a shape of the first aperture is substantially the same as a shape of the second aperture mirrored across a longitudinal axis of the substrate.

Example 6 includes the subject matter of any of Examples 1-5, further including a third aperture in the second conductive layer, the third aperture being opposite from the first and second apertures.

Example 7 provides a slot antenna assembly. The slot antenna assembly includes a slot antenna having a substrate, a conductive layer on a side of the substrate, an aperture in the conductive layer, the aperture oriented about a lateral axis of the substrate, and a slotline in the conductive layer and extending adjacent to a longitudinal axis of the substrate, the slotline in communication with the aperture. The slot antenna assembly further includes an aperture plate defining an antenna aperture and a radome positioned over the antenna aperture.

Example 8 includes the subject matter of Example 7, further including a radio frequency (RF) connector in communication with the slotline.

Example 9 includes the subject matter of any of Examples 7-8, where a width of a first end of the aperture furthest from the slotline is different from a width of a second end of the aperture nearest to the slotline.

Example 10 includes the subject matter of any of Examples 7-9, where a width of the aperture varies as a function of a distance from the slotline.

Example 11 includes the subject matter of any of Examples 7-10, where the aperture is a first aperture, where the slot antenna further includes a second aperture in the conductive layer, and where a shape of the first aperture is substantially the same as a shape of the second aperture mirrored across the longitudinal axis of the substrate.

Example 12 includes the subject matter of Example 11, where the slotline is a first slotline, where the slot antenna further includes a second slotline in the conductive layer, and where a coplanar waveguide includes the first slotline and the second slotline, the coplanar waveguide configured to excite the first and second apertures simultaneously.

Example 13 includes the subject matter of any of Examples 11-12, where the conductive layer is a first conductive layer, where the side of the substrate is a first side of the substrate, and where the slot antenna further includes a second conductive layer on a second side of the substrate, and a third aperture through at least a portion of the second conductive layer.

Example 14 includes the subject matter of any of Examples 8-13, where at least a portion of the slotline is tapered along a length of the longitudinal axis of the substrate.

Example 15 includes the subject matter of any of Examples 7-14, where the slot antenna further includes a plurality of vias in the substrate and surrounding at least a portion of a region including the aperture and the slotline, each of the vias extending through the substrate.

Example 16 provides a slot antenna including a substrate having a first side and a second side; a first conductive layer on the first side of the substrate; a second conductive layer on the second side of the substrate; a first aperture in the first conductive layer, the first aperture oriented about a lateral axis of the substrate; a second aperture in the first conductive layer, the second aperture oriented about the lateral axis; a radio frequency (RF) connector; a coplanar waveguide having a first slotline in the first conductive layer and extending adjacent to a longitudinal axis of the substrate, the first slotline in communication with the RF connector and the first aperture, the coplanar waveguide further having a second slotline in the first conductive layer and extending adjacent to the longitudinal axis of the substrate, the second slotline in communication with the RF connector and the second aperture, the coplanar waveguide configured to excite the first and second apertures simultaneously; and a plurality of vias in the substrate and surrounding at least a portion of a region including the first aperture, the second aperture, the first slotline, the second slotline, and the RF connector, each of the vias extending through the substrate from the first conductive layer to the second conductive layer.

Example 17 includes the subject matter of Example 16, where a width of the first aperture varies as a function of a distance from the first slotline, and where a width of the second aperture varies as a function of a distance from the second slotline.

Example 18 includes the subject matter of any of Examples 16-17, where a width of a first end of the first aperture furthest from the first slotline is greater than a width of a second end of the first aperture nearest to the first slotline, and where a width of a first end of the second aperture furthest from the second slotline is greater than a width of a second end of the second aperture nearest to the second slotline.

Example 19 includes the subject matter of any of Examples 16-18, further including a third aperture in the second conductive layer, the third aperture being opposite from the first and second apertures.

Example 20 includes the subject matter of any of Examples 16-19, where at least a portion of the first slotline is tapered along a length of the longitudinal axis of the substrate; and where at least a portion of the second slotline is tapered along a length of the longitudinal axis of the substrate.

The foregoing description and drawings of various embodiments are presented by way of example only. These examples are not intended to be exhaustive, or to limit the invention to the precise forms disclosed. Alterations, modifications, and variations will be apparent in light of this disclosure and are intended to be within the scope of the invention as set forth in the claims.

What is claimed is:

1. A slot antenna comprising:

a substrate having a first side and a second side;

a first conductive layer on the first side of the substrate;

a second conductive layer on the second side of the substrate;

a first aperture in the first conductive layer;

a second aperture in the first conductive layer;

an aperture plate shaped to match the first and second apertures and defining an antenna aperture; and a coplanar waveguide having a first slotline in the first conductive layer and in communication with the first aperture, and a second slotline in the first conductive layer and in communication with the second aperture, the coplanar waveguide configured to excite the first and second apertures simultaneously.

2. The slot antenna of claim 1, further comprising a plurality of vias in the substrate and surrounding at least a portion of a region including the first aperture, the second aperture, the first slotline, and the second slotline, each of the vias extending through the substrate from the first conductive layer to the second conductive layer.

3. The slot antenna of claim 1, further comprising a radio frequency (RF) connector in communication with the first slotline and the second slotline.

4. The slot antenna of claim 1, wherein a width of the first aperture varies as a function of a distance from the first slotline, and wherein a width of the second aperture varies as a function of a distance from the second slotline.

5. The slot antenna of claim 1, wherein a shape of the first aperture is substantially the same as a shape of the second aperture mirrored across a longitudinal axis of the substrate.

6. The slot antenna of claim 1, further comprising a third aperture in the second conductive layer, the third aperture being opposite from the first and second apertures.

7. A slot antenna assembly comprising:

a slot antenna including:

a substrate, a conductive layer on a side of the substrate, an aperture in the conductive layer, the aperture oriented about a lateral axis of the substrate, and a slotline in the conductive layer and extending adjacent to a longitudinal axis of the substrate, the slotline in communication with the aperture;

an aperture plate defining an antenna aperture; and a radome positioned over the antenna aperture.

8. The slot antenna assembly of claim 7, further comprising a radio frequency (RF) connector in communication with the slotline.

9. The slot antenna assembly of claim 7, wherein a width of a first end of the aperture furthest from the slotline is different from a width of a second end of the aperture nearest to the slotline.

10. The slot antenna assembly of claim 7, wherein a width of the aperture varies as a function of a distance from the slotline.

11. The slot antenna assembly of claim 7, wherein the aperture is a first aperture, wherein the slot antenna further includes a second aperture in the conductive layer, and wherein a shape of the first aperture is substantially the same as a shape of the second aperture mirrored across the longitudinal axis of the substrate.

12. The slot antenna assembly of claim 11, wherein the slotline is a first slotline, wherein the slot antenna further includes a second slotline in the conductive layer, and wherein a coplanar waveguide includes the first slotline and the second slotline, the coplanar waveguide configured to excite the first and second apertures simultaneously.

13. The slot antenna assembly of claim 11, wherein the conductive layer is a first conductive layer, wherein the side of the substrate is a first side of the substrate, and wherein the slot antenna further includes a second conductive layer on a second side of the substrate, and a third aperture through at least a portion of the second conductive layer.

14. The slot antenna assembly of claim 7, wherein at least a portion of the slotline is tapered along a length of the longitudinal axis of the substrate.

15. The slot antenna assembly of claim 7, wherein the slot antenna further includes a plurality of vias in the substrate and surrounding at least a portion of a region including the aperture and the slotline, each of the vias extending through the substrate.

16. A slot antenna comprising:

a substrate having a first side and a second side;

a first conductive layer on the first side of the substrate;

a second conductive layer on the second side of the substrate;

a first aperture in the first conductive layer, the first aperture oriented about a lateral axis of the substrate;

a second aperture in the first conductive layer, the second aperture oriented about the lateral axis;

an aperture plate shaped to match the first and second apertures and defining an antenna aperture;

a radio frequency (RF) connector;

a coplanar waveguide having a first slotline in the first conductive layer and extending adjacent to a longitudinal axis of the substrate, the first slotline in communication with the RF connector and the first aperture, the coplanar waveguide further having a second slotline in the first conductive layer and extending adjacent to the longitudinal axis of the substrate, the second slotline in communication with the RF connector and the second aperture, the coplanar waveguide configured to excite the first and second apertures simultaneously; and a plurality of vias in the substrate and surrounding at least a portion of a region including the first aperture, the second aperture, the first slotline, the second slotline, and the RF connector, each of the vias extending through the substrate from the first conductive layer to the second conductive layer.

17. The slot antenna of claim 16, wherein a width of the first aperture varies as a function of a distance from the first slotline, and wherein a width of the second aperture varies as a function of a distance from the second slotline.

18. The slot antenna of claim 16, wherein a width of a first end of the first aperture furthest from the first slotline is greater than a width of a second end of the first aperture nearest to the first slotline, and wherein a width of a first end of the second aperture furthest from the second slotline is greater than a width of a second end of the second aperture nearest to the second slotline.

19. The slot antenna of claim 16, further comprising a third aperture in the second conductive layer, the third aperture being opposite from the first and second apertures.

20. The slot antenna of claim 16, wherein at least a portion of the first slotline is tapered along a length of the longitudinal axis of the substrate; and wherein at least a portion of the second slotline is tapered along a length of the longitudinal axis of the substrate.

* * * * *